US006282741B1

(12) United States Patent
Manning

(10) Patent No.: US 6,282,741 B1
(45) Date of Patent: Sep. 4, 2001

(54) PORTABLE GOLF BALL CLEANING DEVICE

(76) Inventor: Robert C. Manning, 32 Kessler Farm Dr., No. 505, Nashua, NH (US) 03063

( * ) Notice: Subject to any disclaimer, the term of this patent is extended or adjusted under 35 U.S.C. 154(b) by 0 days.

(21) Appl. No.: 09/270,894

(22) Filed: Mar. 15, 1999

(51) Int. Cl.[7] ..... A47L 13/17
(52) U.S. Cl. ..... 15/104.94; 15/210.1; 401/139
(58) Field of Search ..... 15/104.94, 160, 15/21.2, 210.1; 401/137, 139

(56) References Cited

U.S. PATENT DOCUMENTS

| | | | | |
|---|---|---|---|---|
| 2,968,825 | * | 1/1961 | Wetherby | 15/210.1 |
| 3,160,304 | * | 12/1964 | Peacock . | |
| 3,806,983 | | 4/1974 | Cunningham et al. . | |
| 4,210,974 | | 7/1980 | Stoltzman . | |
| 4,345,704 | | 8/1982 | Boughton . | |
| 4,414,692 | | 11/1983 | Dzierson et al. . | |
| 4,464,072 | * | 8/1984 | Norwell | 15/21.2 |
| 4,504,980 | | 3/1985 | Butcher . | |
| 4,701,968 | | 10/1987 | Stoltzman . | |
| 4,953,999 | | 9/1990 | Rivers . | |
| 4,955,747 | | 9/1990 | Tarver . | |
| 5,075,918 | * | 12/1991 | Zeltner et al. | 15/210.1 |
| 5,131,112 | | 7/1992 | Cervini . | |
| 5,240,156 | | 8/1993 | Sicotte et al. . | |
| 5,339,486 | | 8/1994 | Persic . | |
| 5,443,192 | | 8/1995 | Hodges et al. . | |
| 5,497,920 | | 3/1996 | Moeller et al. . | |
| 5,572,761 | * | 11/1996 | Meyer | 15/160 |
| 5,641,232 | | 6/1997 | Frey . | |
| 5,770,284 | * | 6/1998 | Logemann | 15/210.1 |
| 5,871,132 | | 2/1999 | Hargreaves . | |
| 5,879,094 | | 3/1999 | Lersch et al. . | |
| 5,898,968 | | 4/1999 | Beattie . | |

* cited by examiner

*Primary Examiner*—Terrence R. Till
(74) *Attorney, Agent, or Firm*—Lambert & Assoc., PLLC; Gary E. Lambert; Donald J. MacDonald

(57) ABSTRACT

A golf ball cleaning device carried by the user for the purpose of cleaning his or her golf ball prior to "teeing of" or putting. The device consists of a plastic spray bottle, a towel or cloth, which is removable, attached to the bottle and device for fastening the entire unit to the user's golf bag. The device allows the user to fasten the spray bottle and towel unit to his or her golf bag and quickly and conveniently unfasten the unit upon reaching the green. After properly marking the ball on the green, the user is able to spray the contents of the bottle onto his or her golf ball and, by utilizing the attached towel, clean and dry the golf ball prior to putting. After putting, the unit is again conveniently fastened to the users golf bag utilizing the swivel clip.

4 Claims, 5 Drawing Sheets

PORTABLE GOLF BALL CLEANING DEVICE

BACKGROUND OF THE INVENTION

This invention relates generally to a portable device designed to clean golf balls while one is engaged in the sport of golfing. More specifically, the invention relates to an easily accessible combination of a spray bottle conveniently and removably attached to a portion of terry cloth that can be clipped to a standard golf bag.

While golf is a very popular sport and is played regularly for recreation, it is a sport of strict and unforgiving rules. During a round of golf, a golfer may clean his or her ball on two different occasions; prior to teeing off at every hole or after properly marking his or her ball on the green or putting surface. Often, when a golfer makes an approach shot to the green, the high trajectory of the ball will permit the ball to penetrate the surface of the green thus leaving the ball marked with dirt, grass stains and or the chemicals applied to the putting surface by the grounds crew. Should the ball be covered with one or all of the above, it is desirable for the golfer to remove the substances prior to putting the ball.

Large golf towels attached to a golf bag via a hooking device are a common sight on a golf course. Although these towels are generally used for cleaning golf clubs, they have, on occasion, been used to wipe balls clean prior to putting. Utilizing a large golf towel to clean a ball prior to putting is both inconvenient and cumbersome due to the lack of quick release of the towel from the golf bag, the large size of the towel and the ineffective cleaning of the ball due to the lack of water and or cleaning agent.

SUMMARY OF THE INVENTION

There is provided, in accordance with the present invention, a towel and spray bottle for golf bags that combines the advantages of comparatively small size, light weight, reliability and ease of use and, therefore, represents a substantial improvement over the basic golf towel. The invention comprises a terry cloth, or other fabric, towel connected to a spray bottle via VELCRO or a VELCRO equivalent. The towel and bottle unit is attached to a swivel snap clip or other device. The entire unit is attached to a golf bag utilizing the swivel snap clip fastening device and the loops available on the golf bag. The towel around the bottle is removable and replaceable utilizing the VELCRO, or its equivalent, loop and hook fastening system.

This invention provides a golfer with the hands-free convenience of carrying both a spray bottle, filled with water or other cleaning agent, and an attached towel for cleaning and drying the ball. Upon reaching the green or putting surface, the entire unit is detached from the golf bag utilizing the swivel snap clip release. Upon properly marking the ball on the green, the golfer may pick up his or her ball, remove the cap from the invention, spray the ball with the contents of the bottle and proceed to clean and dry the ball with the attached towel. Upon completion of cleaning, and drying the ball, the golfer may either attach the invention to the belt loops on his or her pants utilizing the swivel snap clip fastening device or may place the unit on the green or putting surface prior to putting.

The invention will not only clean a golfer's ball prior to putting, it will also minimize the possibility of ingestion of golf course chemicals caused by a golfer licking his or her golf ball in an effort to clean any dirt or grass stains prior to putting. The invention will also remove the need to wipe a dirty golf ball on a golfer's shirt, pants or shorts.

DETAILED DESCRIPTION OF THE PREFFERED EMBODIMENT

Figure 1:
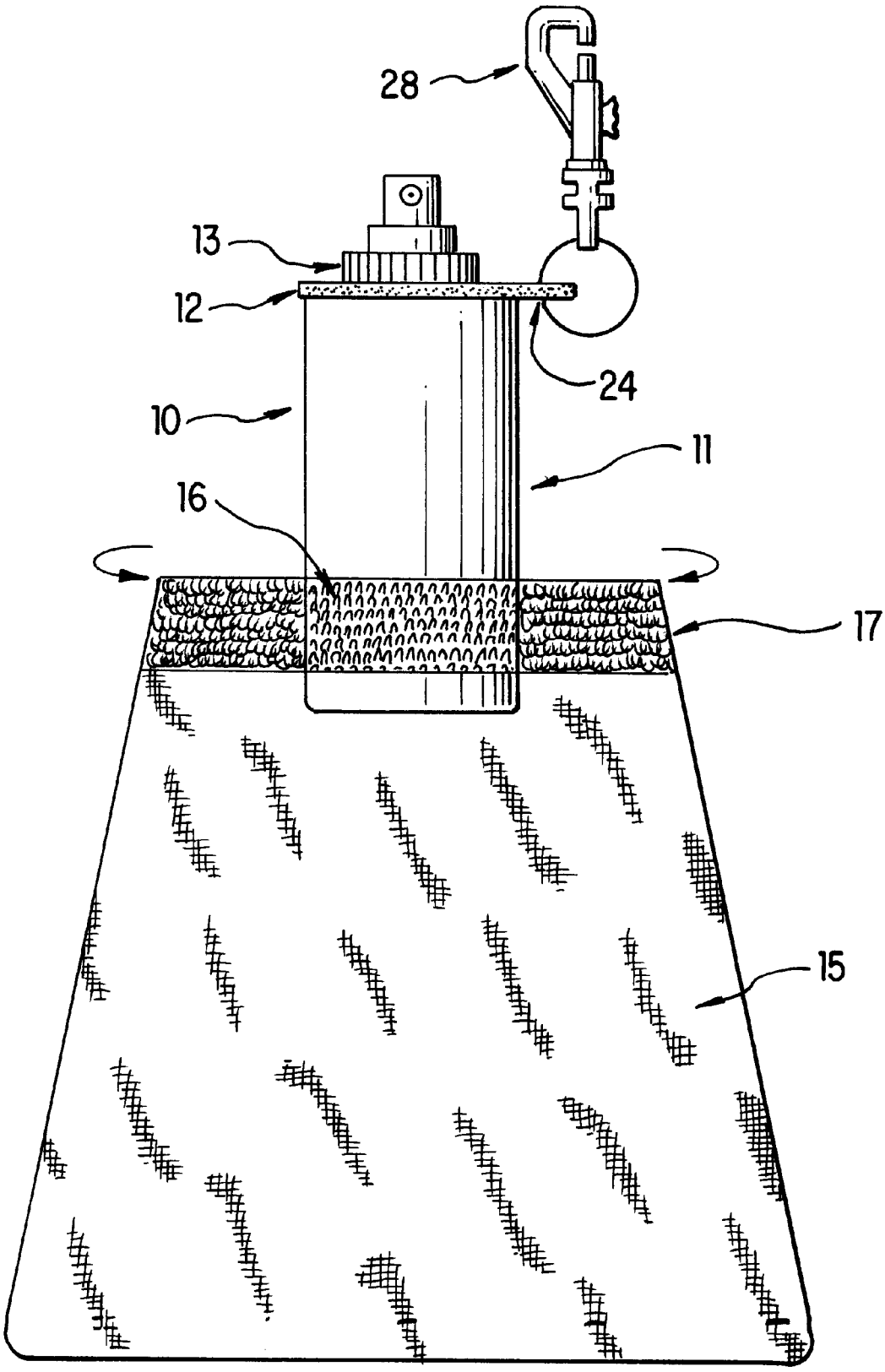
FIG. 1 is an elevational view of the embodiment.

Referring now to FIG. 1, the portable golf club cleaning device is shown generally at 10. Device 10 is comprised of the combination of a spray bottle 11, a flexible collar 12, which fits under and around the sprayer neck 13 of bottle 11, to which a snap clip 28 is fastened to an aperture 24 within collar 12, and a portion of terry cloth 15 removably attached to bottle 11 by hook fastener 16 and loop fastener 17.

Figure 2:
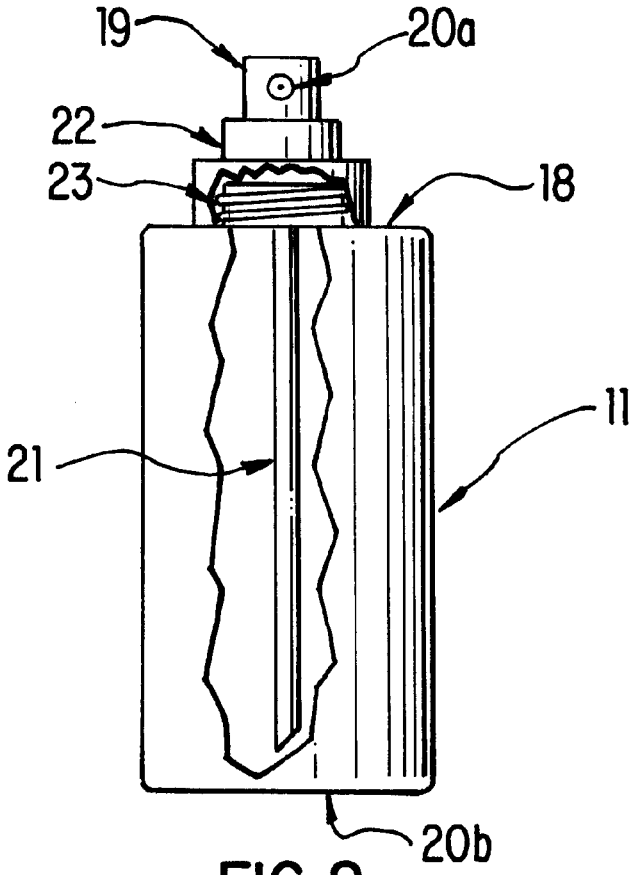
FIG. 2 is an elevational cross-section view of the spray bottle of the embodiment.

Spray bottle 11 is shown more particularly in FIG. 2 where, according to a preferred embodiment of the invention, there is shown a plastic bottle 11 with an open top end 18, capped with a finger tip sprayer 19, and a closed bottom end 20*b*. Plastic bottle 11, which can be made from PVC, EPET, OPET, HDPE or BAREX, has, in its preferred embodiment, the capacity to hold two fluid ounces of liquid or more, depending upon the size of bottle 11. Finger tip sprayer 19 consists of a pump spray nozzle 20*a*, made of one of the above listed plastics, and a hollow tube/straw component 21, which, when pump spray nozzle 20 is tightened onto the top of the plastic bottle 11 using sprayer neck 13, is submerged in the bottle's 11 contents to within a quarter inch of the bottom to allow for the extraction of the bottle's 11 contents via the user depressing the pump 22 on the top of spray nozzle 20. Upon unscrewing and removing finger tip sprayer 19 from the bottle itself, the neck 23 of the bottle is exposed. The neck 23 of the bottle, varying in height, consists of a spiral thread, also made of plastic, which allows for the tightening of the finger tip sprayer 19 when the two units are married and turned in a clockwise fashion.

Figure 3:
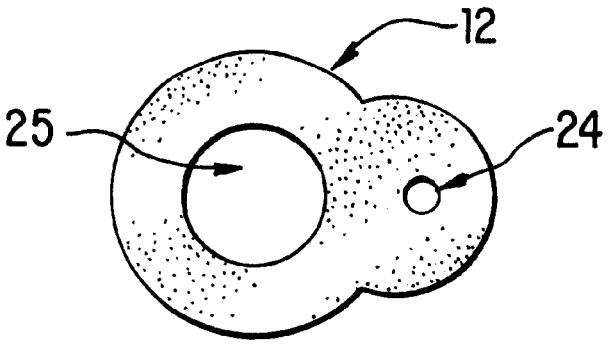
FIG. 3 is a top view of the collar of the embodiment.

A flexible collar 12, as shown in FIG. 3, approximately 1.5 inches wide (at its widest point) and 1⅞ inches long, made of ⅛ inch rubber or flexible polyurethane, and cut from a manufacturing dye, will be placed over neck 23 of bottle 11 utilizing a hole 25, approximately ⅝ inch in diameter cut by the above referenced dye. Collar 12 will also consist of an aperture 24 that is approximately ⅛ inch in diameter and centered on the more narrow end of collar 12, which is approximately 1⅛ inches wide.

Figure 4:
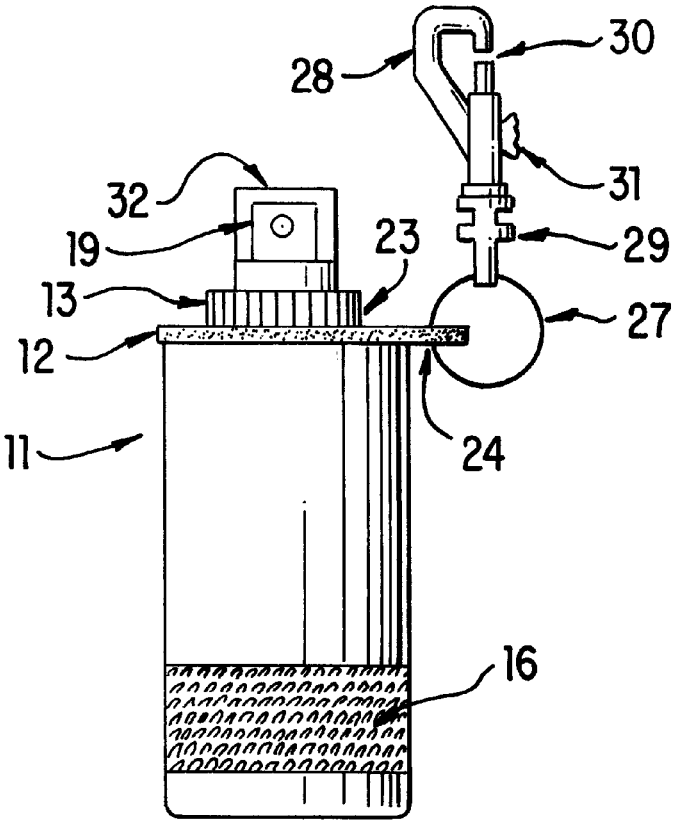
FIG. 4 is an elevational view of the embodiment without the cloth that is shown in FIG. 1.
Figure 5:
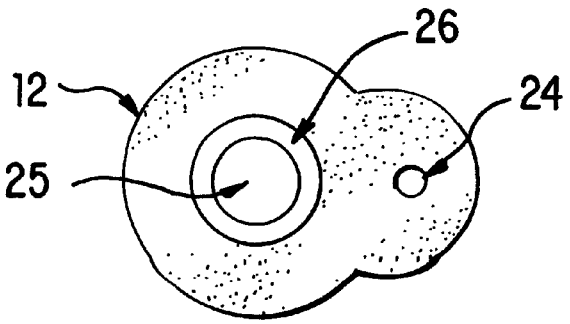
FIG. 5 is a top view of the collar more clearly depicting the area of the collar covered by the sprayer neck when the sprayer is attached to the bottle.

As shown more clearly in FIG. 4, upon placement of collar 12 over neck 23 of bottle 11, thus having collar 12 resting atop the outside of bottle 11, finger tip sprayer 19 having straw/tube component 21 is lowered into the open end 18 of bottle 11 and finger tip sprayer 19 is lowered onto the threads of neck 23 of bottle 11 by use of sprayer neck 13. In a clockwise fashion, finger tip sprayer 19 is turned, thus lowering sprayer 19 on top of collar 12, thus holding collar 12 in place atop the outside portion of bottle 11. FIG. 5 more vividly shows how collar 12 is viewed, from above, when sprayer neck 13 is placed over collar 12, hereby depicted by the "white" portion 26 between hole 25 and collar 12.

Referring now again to FIG. 4, with flexible collar 12 firmly in place due to the tightening of finger tip sprayer 19 on to bottle 11, the ring 27 of swivel snap clip 28 is attached to collar 12 through aperture 24 in collar 12. Swivel snap clip 28 is a standard clip, made of plastic or metal, to which a swivel 29 is attached, which allows clip 28 and ring 27, also made of plastic or metal, to rotate freely with respect to each other. The combination of clip 28, swivel 29 and ring 27 allows clip 28 to be attached to numerous different items utilizing the hooking device 30 shown. When a user wishes to "hook" clip 28 onto another object, the user simply puts his or her thumb or finger on release lever 31, located on the side of clip 28, and depresses lever 31. Upon depressing lever 31, a portion of hooking device 30, a small, moveable piece of vertical plastic or metal will separate from a permanently placed portion of clip 28, thus creating an opening which will allow another object to enter the void which has been created. When the user releases the previously depressed lever 31, the small, moveable piece of vertical plastic or metal will return to its original position, abutting the permanently placed portion of clip 28, thus trapping the other object in the void, resulting in the clip 28 hanging from the other object.

Figure 6:
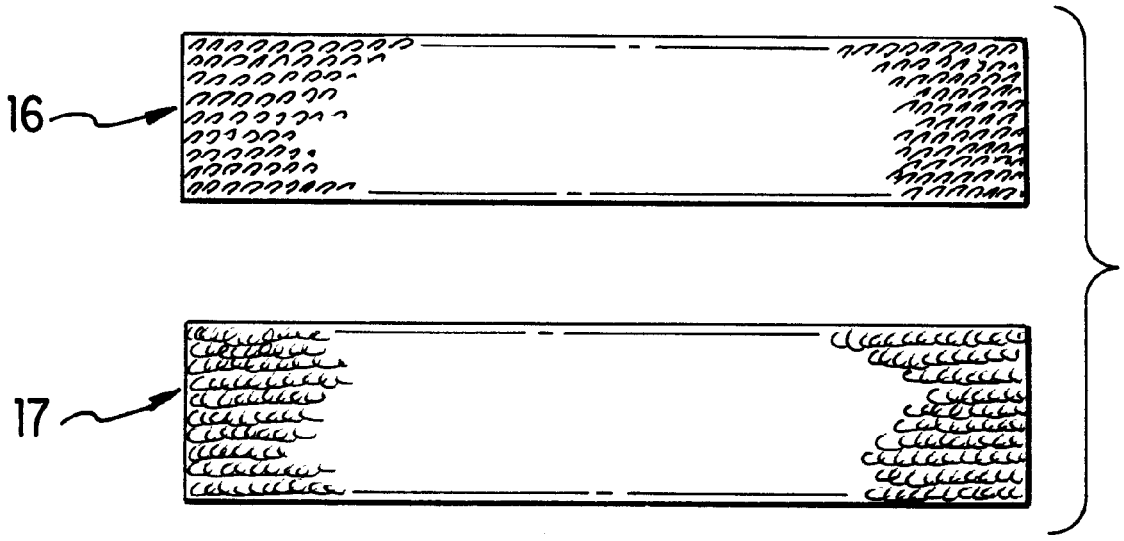
FIG. 6 is an elevational view of the strip of the hook fastener and the strip of the loop fastener.
Figure 7:
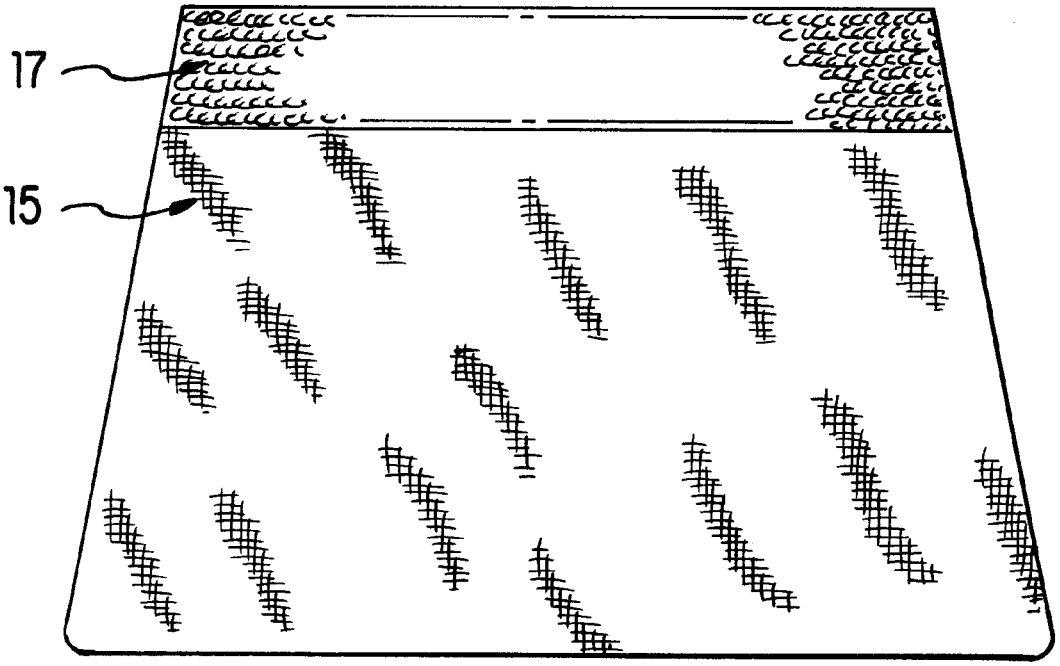
FIG. 7 is an elevational view of the loop fastener attached to the cloth.

After assembling both flexible collar 12 and swivel snap clip 28 to bottle 11, a 4.5 inch strip, depending on the girth of the bottle, of a hook fastener 16 of the hook portion of a VELCRO hook and loop fastening system, or its equivalent loop and hook type fastening system, as shown in FIG. 6, is adhered to the side/bottom of bottle 11, as shown in FIG. 4, utilizing a pressure sensitive adhesive on the backside of the hook fastener strip 16. This adhesive should cure for 24 hours to ensure maximum strength. The loop fastener 17 portion of the VELCRO fastening system, shown in FIG. 6, also 5 inches, is sewed to the top of a piece of pre-cut 11.5 oz woven velour Terry 100% cotton cloth 15, or other fabric, resulting in the combination shown in FIG. 7. Terry cloth 15 is machine or hand cut in accordance with specifications as follows: the top portion of the terry cloth 15 is 5 inches long, both the vertical sides measure 12 inches long and the bottom of the towel is 9 inches wide, thus creating a tapered cloth 15.

Figure 8:
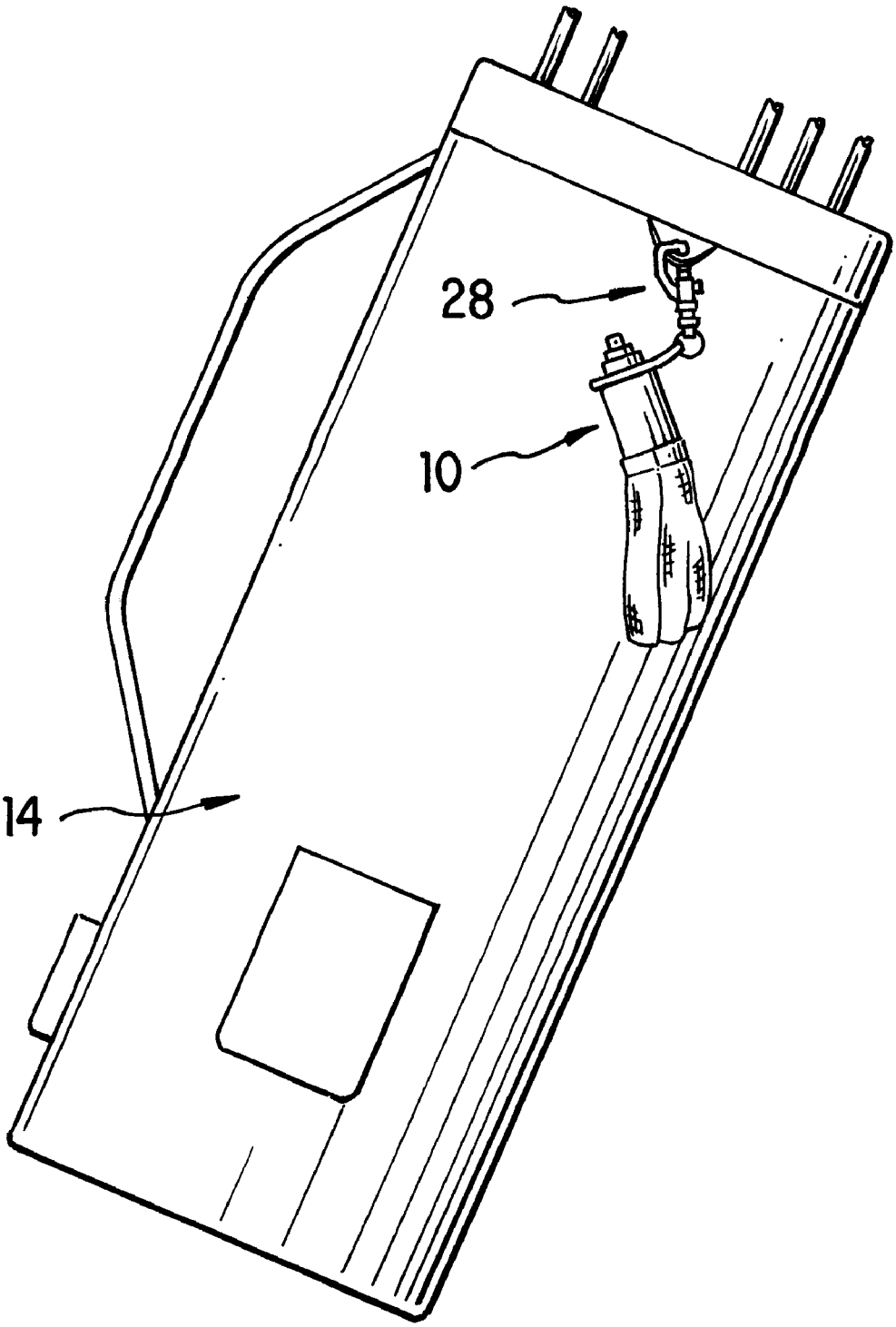
FIG. 8 is an elevational view of the embodiment attached to a standard golf bag.

Referring again to FIG. 1, the tapered terry cloth 15, with loop fastener 17 of the VELCRO or its equivalent securely and permanently attached and facing inwards, is then married to the side/bottom of bottle 11 to hook fastener 16 portion of the VELCRO or its equivalent. The marrying of these two components, hook fastener 16 with loop fastener 17, combined with the wrapping of terry cloth 15 completely around bottle 11 as to make sure all the hook and loop fasteners 16 and 17 are fastened together, creates a secure but removable "skirt" for bottle 11. As depicted in FIG. 8, the entire device 10, in its preferred embodiment, can then be fastened to a user's golf bag 14 utilizing clip 28 as previously described.

The user then has the ability to fill bottle 11 with water or other cleaning agent prior to playing a round of golf, fastening the entire device 10 to his or her golf bag 14, carrying device 10 without the use of his or her hands to the green or putting surface, releasing clip 28 from his or her bag 14, thus allowing the user to hand carry device 10 onto the putting surface. After properly marking his or her golf ball, the user would pick up his or her golf ball, either put the ball into terry cloth 15 or hold the ball in his or her free hand. Upon removing a plastic cap 32, FIG. 4, from finger tip sprayer 19, the user would press down on finger tip sprayer 19, pump same, thus releasing, via the plastic tube/straw component 21, the contents of bottle 11 onto the ball. After wetting the ball sufficiently, the user would then wrap the ball in the attached terry cloth 15, thus wiping the dirt, grass stains and golf course chemicals from the ball onto cloth 15. After the ball is cleaned to the user's desire, cap 32 in put back on finger tip sprayer 19 and the device 10 is placed on the green or putting surface until such a time where the user walks back to his or her bag 14 and re-hooks the entire device 10 to bag 14.

Should the user decide to wash the terry cloth 15 of the device 10, due to accumulating dirt or grass stains, or should he or she wish to replace the cloth 15 with a different color cloth 15, the user is able to do so by separating the hook and loop fasteners 16 and 17 of the VELCRO or its equivalent. This will result in the cloth 15 separating from bottle 11 of device 10 thus creating two separate components. In its preferred embodiment, cloth 15 will be replaceable in varying colors.

It is to be understood that the present invention is not limited to the sole embodiment described above, but encompasses any and all embodiments within the scope of the following claims.

I claim:

1. A portable golf ball cleaning device, comprising:

a spray bottle;

a portion of cloth;

a clip;

means for removably fastening said portion of cloth to said spray bottle;

means for removably attaching said clip to said spray bottle.

a hook fastener adhesively applied to said bottle; and a loop fastener securely attached to said cloth wherein said loop fastener is joined to said hook fastener thereby fastening said cloth to said bottle.

2. The portable golf ball cleaning device according to claim 1, wherein said attaching means comprise:

a collar attached to said bottle; and a ring, movably joined to said clip, attached to said collar.

3. The portable golf ball cleaning device according to claim 2, further comprising a swivel rotatably joined to and between said ring and said clip.

4. The portable golf ball cleaning device according to claim 2, wherein said device is attached to a golf bag.

* * * * *